US011166509B2

(12) United States Patent
Leipold

(10) Patent No.: US 11,166,509 B2
(45) Date of Patent: Nov. 9, 2021

(54) SAFETY HELMET WITH AN AERODYNAMIC STABILIZING ELEMENT

(71) Applicant: Bayerische Motoren Werke Aktiengesellschaft, Munich (DE)

(72) Inventor: Georg Leipold, Pfaffenhofen/Ilm (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 242 days.

(21) Appl. No.: 15/794,100

(22) Filed: Oct. 26, 2017

(65) Prior Publication Data

US 2018/0055132 A1 Mar. 1, 2018

Related U.S. Application Data

(63) Continuation of application No. PCT/EP2016/068620, filed on Aug. 4, 2016.

(30) Foreign Application Priority Data

Aug. 27, 2015 (DE) ..... 10 2015 216 436.5

(51) Int. Cl.
*A42B 3/04* (2006.01)

(52) U.S. Cl.
CPC ..... *A42B 3/0493* (2013.01); *A42B 3/0433* (2013.01)

(58) Field of Classification Search
CPC ..... A42B 3/0493; A42B 3/0433
See application file for complete search history.

(56) References Cited

U.S. PATENT DOCUMENTS 4,586,197 A * 5/1986 Hubbard ..... A42B 3/0493 2/410
4,995,117 A * 2/1991 Mirage ..... A42B 3/0493 2/410

(Continued)

FOREIGN PATENT DOCUMENTS

CN 100588339 C 2/2010
CN 201894223 U 7/2011

(Continued)

OTHER PUBLICATIONS

International Search Report (PCT/ISA/210) issued in PCT Application No. PCT/EP2016/068620 dated Nov. 10, 2016 with English translation (four (4) pages).

(Continued)

*Primary Examiner* — Richale L Quinn
(74) *Attorney, Agent, or Firm* — Crowell & Moring LLP

(57) ABSTRACT

A safety helmet, in particular a safety helmet for drivers of single-track motorcycles, is provided. The safety helmet includes at least one movable aerodynamic stabilizing element and at least one sensor element for detecting one or more current driving state variables. The aerodynamic stabilizing element is controlled depending on at least one current driving state variable detected by the sensor element. An actuator element for moving the aerodynamic stabilizing element may be provided, and may be controlled by a control unit depending on at least one current driving state variable detected by the sensor element. One or more of the sensor element, actuator element and the controller may be supplied with electrical energy from an energy supply unit.

14 Claims, 2 Drawing Sheets

(56) References Cited

U.S. PATENT DOCUMENTS

| | | | | |
|---|---|---|---|---|
| 5,023,958 | A * | 6/1991 | Rotzin | A42B 3/0493 2/411 |
| 5,409,287 | A * | 4/1995 | Suzuki | A42B 3/0493 15/313 |
| 5,575,018 | A | 11/1996 | Rothrock | |
| 5,996,128 | A * | 12/1999 | Yanagihara | A42B 3/281 2/422 |
| 6,263,513 | B1 * | 7/2001 | Murakami | A42B 3/0493 2/171.3 |
| 7,574,754 | B2 * | 8/2009 | Arai | A42B 3/0493 2/410 |
| 7,748,059 | B2 * | 7/2010 | Arai | A42B 3/0493 2/171.3 |
| 8,156,570 | B1 * | 4/2012 | Hockaday | A41D 13/0025 2/7 |
| 8,695,121 | B2 * | 4/2014 | Nolan | A42B 3/286 2/171.3 |
| 8,726,425 | B2 * | 5/2014 | Murakami | A42B 3/0493 2/410 |
| 9,370,217 | B2 * | 6/2016 | Arai | A42B 3/283 |
| 9,861,151 | B2 * | 1/2018 | Ciaramelletti | A42B 3/046 |
| 10,098,401 | B2 * | 10/2018 | Weller | A42B 3/0406 |
| 10,368,602 | B2 * | 8/2019 | Dodson | |
| 2006/0248631 | A1 * | 11/2006 | Arai | A42B 3/0493 2/424 |
| 2007/0063541 | A1 * | 3/2007 | Browne | B62D 35/00 296/180.1 |
| 2011/0261453 | A1 * | 10/2011 | Felt | A42B 3/0426 359/481 |
| 2013/0054143 | A1 * | 2/2013 | DeGolier | G01L 1/247 702/3 |
| 2013/0305437 | A1 * | 11/2013 | Weller | A42B 3/0406 2/422 |
| 2014/0298570 | A1 | 10/2014 | Cobb | |
| 2015/0135416 | A1 * | 5/2015 | Hendl | A42B 3/227 2/424 |
| 2015/0173445 | A1 * | 6/2015 | Gordon | F25B 21/04 62/3.3 |
| 2016/0143383 | A1 * | 5/2016 | Allen | A42B 3/0486 2/413 |
| 2016/0270472 | A1 * | 9/2016 | Allen | A41D 13/018 |
| 2016/0309827 | A1 * | 10/2016 | Dodson | A42B 3/30 |
| 2017/0196281 | A1 * | 7/2017 | Rosati | A61M 16/0003 |
| 2018/0027916 | A1 * | 2/2018 | Smallwood | A42B 3/12 |

FOREIGN PATENT DOCUMENTS

| | | | | |
|---|---|---|---|---|
| CN | 104114440 | A | 10/2014 | |
| DE | 201 01 053 | U1 | 5/2001 | |
| DE | 11 2006 002 539 | T5 | 7/2008 | |
| DE | 10 2012 214 061 | A1 | 5/2014 | |
| EP | 0 568 101 | A1 | 11/1993 | |
| EP | 0 650 673 | A1 | 5/1995 | |
| EP | 0650673 | A1 * | 5/1995 | A42B 3/283 |
| EP | 2 044 854 | A2 | 4/2009 | |
| EP | 2 380 450 | A1 | 10/2011 | |
| JP | 10-291499 | A | 11/1998 | |

OTHER PUBLICATIONS

German-language Search Report issued in counterpart German Application No. 10 2015 216 436.5 dated Apr. 20, 2016 with partial English translation (ten (10) pages).

German-language Written Opinion (PCT/ISA/237) issued in PCT Application No. PCT/EP2016/068620 dated Aug. 27, 2015 (five (5) pages).

English Translation of Chinese-language Office Action issued in counterpart Chinese Application No. 201680025188.2 dated Oct. 22, 2019 (seven (7) pages).

English translation of Chinese Office Action issued in Chinese Application No. 201680025188.2 dated May 12, 2020 (eight pages).

* cited by examiner

SAFETY HELMET WITH AN AERODYNAMIC STABILIZING ELEMENT

CROSS REFERENCE TO RELATED APPLICATIONS

This application is a continuation of PCT International Application No. PCT/EP2016/068620, filed Aug. 4, 2016, which claims priority under 35 U.S.C. § 119 from German Patent Application No. 10 2015 216 436.5, filed Aug. 27, 2015, the entire disclosures of which are herein expressly incorporated by reference.

BACKGROUND AND SUMMARY OF THE INVENTION

The present invention is directed to safety helmet having at least one aerodynamic stabilizing element. The safety helmet can be, in particular, a safety helmet for a motorcyclist of a motor vehicle such as e.g. a motorcycle helmet for a motorcyclist.

Motorcycle helmets frequently have aerodynamic elements which are intended to make driving under certain influencing factors as pleasant as possible. These aerodynamic elements are usually embodied in a static fashion, with the result that depending on the motorcyclist's size, and the speed and/or the aerodynamic qualities of the motorcycle they cannot entirely achieve their full potential.

Documents EP 0 650 673 A1 and EP 2 044 854 A2 describe safety helmets for motorcyclists which have movable aerodynamic elements. In this context, the aerodynamic elements are either adjusted manually by the motorcyclist or the position of the aerodynamic elements changes as a function of the direction and/or the strength of the airstream.

A disadvantage with safety helmets described in the prior art is that the helmet can only be insufficiently stabilized by means of the aerodynamic elements, in particular if the motorcyclist wearing the safety helmet carries out rapid driving maneuvers. As a result, the motorcyclist's musculature, in particular in the neck area, is subjected to severe stress.

An object to be achieved by at least some of the embodiments is to provide a safety helmet with at least one aerodynamic stabilizing element by which the head of the motorcyclist wearing the safety helmet can be stabilized even during rapid maneuvers.

According to at least one embodiment, a safety helmet described here comprises at least one aerodynamic stabilizing element and at least one sensor element for detecting one or more current driving state variables. The safety helmet is preferably a safety helmet of a motorcyclist of a motor vehicle, for example of a single-track motorcycle. For example, the safety helmet can be for a motorcyclist or a rider of a motor scooter or moped. Furthermore, it may be a safety helmet of a driver of what is referred to as a quad bike or ATV ("All Terrain Vehicle"). The sensor element can be integrated, for example, in the safety helmet or in a helmet shell of the safety helmet.

The aerodynamic stabilizing element is preferably designed such that it is controlled or moved as a function of at least one current driving state variable detected by the sensor element. For example, the aerodynamic stabilizing element can be arranged in a movable fashion with respect to a helmet shell of the safety helmet and can be moved with respect to the helmet shell at least into a first position and into a second position which is different from the first position as a function of the detected current driving state variable. The current driving state variable can be, for example, the current speed or the current acceleration.

The aerodynamic stabilizing element is particularly preferably designed in such a way that it can be moved into a multiplicity of different positions as a function of the current driving state variable which is detected by the sensor element, in order to stabilize the safety helmet.

The aerodynamic stabilizing element can have e.g. a planar body. The aerodynamic stabilizing element preferably projects from the helmet shell of the safety helmet, i.e. the aerodynamic stabilizing element can project or protrude e.g. from a surface of the helmet shell, with the result that the aerodynamic stabilizing element can function as an air guiding component or air deflecting component. The aerodynamic stabilizing element can also be referred to here and below as aerodynamic element or as active aerodynamic element or active aerodynamic stabilizing element.

According to a further embodiment, the aerodynamic stabilizing element is designed in such a way that it is arranged so as to be movable with respect to the helmet shell of the safety helmet about at least one axis. The aerodynamic stabilizing element is preferably arranged so as to be movable with respect to the helmet shell about a plurality of axes. Therefore, the aerodynamic stabilizing element can be an aerodynamic element which is movable about multiple axes. The aerodynamic stabilizing element is particularly preferably designed in such a way that it can be deflected with respect to three movement axes.

According to a further embodiment, the sensor element is embodied as an inertial sensor which is designed to measure accelerations and/or rates of rotation. For example, the sensor element can be embodied as an acceleration sensor. The acceleration sensor is preferably designed in such a way that it can detect a current acceleration as a current driving state variable. For example, the sensor element can be embodied as a multi-axis acceleration sensor, in particular as a three-axis acceleration sensor.

According to a further embodiment, the aerodynamic stabilizing element is designed in such a way that it is controlled or moved by at least one actuator element. The actuator element can be embodied, for example, as a piezo-actuator. The safety helmet or the aerodynamic stabilizing element preferably has at least two actuator elements, particularly preferably at least three actuator elements, by which the aerodynamic stabilizing element can be deflected. The actuator elements can be embodied e.g. all as piezoelectric actuators.

According to a further embodiment, the safety helmet comprises at least one further sensor element, wherein the aerodynamic stabilizing element is designed in such a way that it is moved or deflected as a function of at least one current driving state variable which is detected by the further sensor element. The further sensor element can be embodied e.g. as a pressure sensor. The pressure sensor is preferably designed to measure a wind pressure of an airstream. Furthermore, the further sensor element can be embodied, for example, as a speed sensor which measures a current speed as a current driving state variable.

According to a further embodiment, the safety helmet comprises at least one control unit which is designed to record measurement variables which are detected by the sensor element. Furthermore, the control unit is preferably designed in such a way that it controls the aerodynamic stabilizing element as a function of the recorded measurement variables. For example, the control unit can control the aerodynamic stabilizing element by actuating one or more actuator elements.

According to a further embodiment, the safety helmet comprises a further aerodynamic stabilizing element which is designed in such a way that it is controlled as a function of a current driving state variable which is detected by the sensor element. In addition to the aerodynamic stabilizing element and the further aerodynamic stabilizing element, the safety helmet can have one or more further aerodynamic stabilizing elements which are controlled as a function of at least one current driving state variable which is detected by the sensor element. The further aerodynamic stabilizing elements can have, for example, one or more features of the embodiments which are disclosed in conjunction with the first aerodynamic stabilizing element.

According to a further embodiment, the safety helmet comprises an energy supply unit. The energy supply unit is preferably connected to the aerodynamic stabilizing element or to the actuator element and/or to the sensor element. Furthermore, the energy supply unit can be connected to the control unit. The energy supply of the aerodynamic stabilizing element, of the sensor element and/or of the control unit can be ensured by the energy supply unit. For example, the energy supply unit can be embodied as a battery or as an accumulator. The energy supply unit is preferably integrated into the safety helmet or into a helmet shell of the safety helmet.

According to a further embodiment, the safety helmet has an energy interface. The energy interface is preferably connected to the energy supply unit and is designed to charge the energy supply unit. For example, the energy interface can be embodied as a plug or as a socket. According to a further embodiment, the energy supply unit can additionally or alternatively be charged by induction.

According to a further embodiment, the aerodynamic stabilizing element is designed in such a way that it is controlled as a function of at least one current driving state variable which is detected and transmitted by a vehicle. For example, the vehicle can measure one or more current driving state variables by means of one or more sensors, such as e.g. by means of an oblique position sensor, a speed sensor and/or an acceleration sensor or by means of an integrated global position-determining system (GPS), and transmit signals derived from the recorded measurement variables to the safety helmet. For example, the signals can be initially transmitted to a control unit which can be integrated either into the vehicle or into the safety helmet, and the aerodynamic stabilizing element or the aerodynamic stabilizing elements can then be controlled by the control unit as a function of the measurement variables, e.g. by actuating one or more actuator elements.

The head of a motorcyclist wearing the safety helmet can be stabilized even during rapid driving maneuvers by the safety helmet described here and the integrated aerodynamic stabilizing element, with the result that the motorcyclist's musculature is subjected to less stress. Furthermore, the lift and the down thrust in different positions on the vehicle can also be adjusted.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
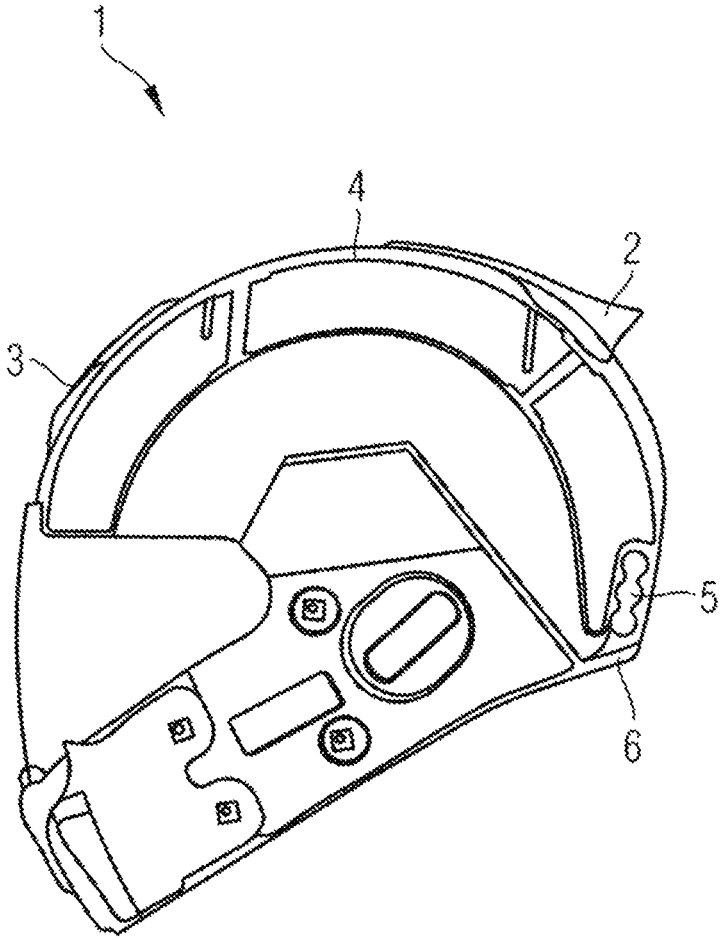
FIG. 1 is a side view of a safety helmet in accordance with an embodiment of the present invention.
Figure 2:
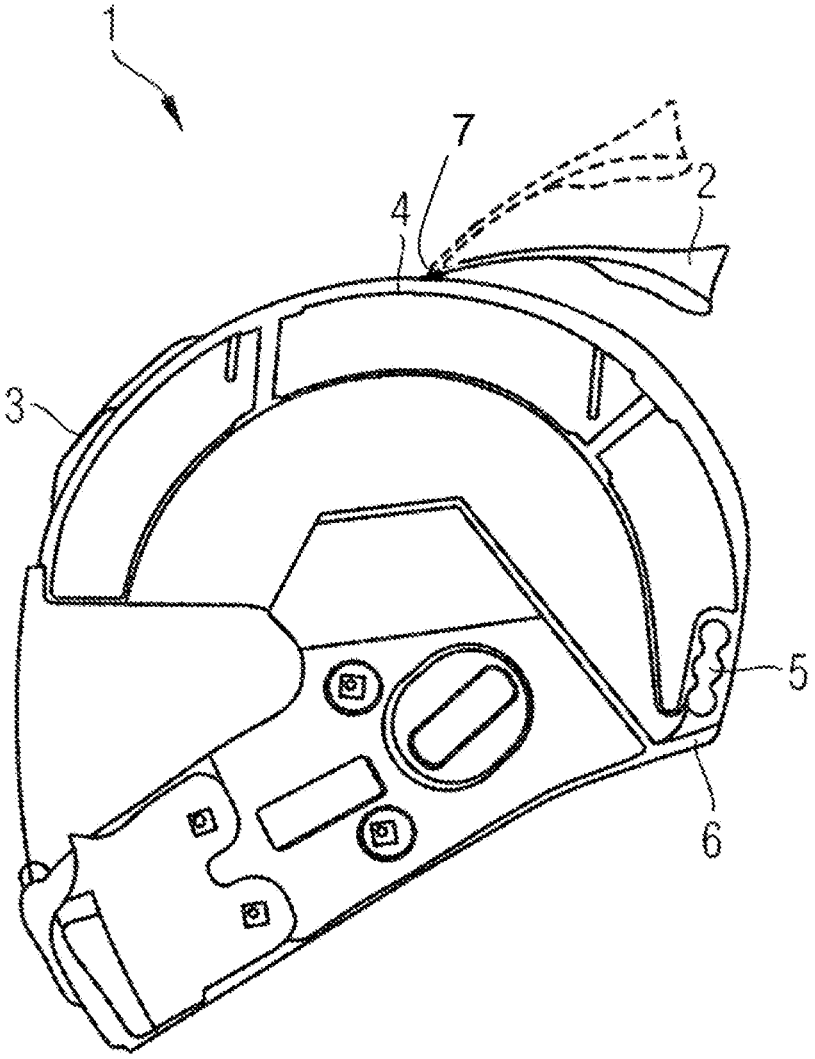
FIG. 2 is a side view of the safety helmet in FIG. 1 with an aerodynamic stabilizing unit in a second position.

FIG. 1 shows a safety helmet 1 which has an aerodynamic stabilizing element 2 which is movably connected to a helmet shell 4 of the safety helmet 1. Furthermore, the safety helmet 1 has a sensor element 3 for detecting one or more current driving state variables. In the exemplary embodiment shown, the sensor element 3 is embodied as a three-axis acceleration sensor. The aerodynamic stabilizing element 2 is embodied in such a way that it is deflected as a function of at least one current driving state variable which is detected by the sensor element 3, for example from a first position shown in FIG. 1 to the second and third positions shown in FIG. 2, rotating about pivot 7. For example, a current acceleration can be measured by the sensor element 3, and the resulting measurement variables are transmitted to a control unit (not shown) by signal transmission. For this purpose, the sensor element 3 can be connected to the control unit by a cable connection. Alternatively, the signals relating to the measured measurement variables can be transmitted to the control unit from the sensor element 3 by a cableless transmission method such as e.g. Bluetooth, WLAN etc. In order to control the aerodynamic stabilizing element, the control unit can be connected to the aerodynamic stabilizing element, also by a cable connection. The control signals can alternatively also be transmitted to the aerodynamic stabilizing element by a cableless transmission method.

The safety helmet 1 also has an energy supply unit 5 which can be integrated into the safety helmet 1 or into the helmet shell 4 of the safety helmet 1. The sensor element and the aerodynamic stabilizing element can be supplied with electrical energy by the energy supply unit 5. In order to charge the energy supply unit 5, the safety helmet 1 has an energy interface 6. For example, the energy interface 6 can be embodied as a plug or a socket. Alternatively, the energy transmission can also be carried out in a wireless fashion, for example by inductive charging of the energy supply unit 5.

In addition to the aerodynamic stabilizing element 2 shown, the safety helmet 1 can have a multiplicity of further aerodynamic stabilizing elements which can also be designed in such a way that they are controlled as a function of at least one detected current driving state variable which is measured by the sensor element. The further aerodynamic stabilizing elements can be arranged, for example, on two opposite sides of the safety helmet 1.

Furthermore, the safety helmet 1 can have one or more further sensor elements which can be integrated into the safety helmet 1 or into the helmet shell 4 of the safety helmet 1, and by which one or more further driving state variables can be measured. The further sensor elements can be embodied, for example, as a pressure sensor or as a speed sensor.

Alternatively it is also conceivable for the sensor element and/or the further sensor elements to be integrated into a vehicle and for measurement variables which characterize a current driving state to be transmitted by a cableless transmission method to the aerodynamic stabilizing element 2 of the safety helmet 1 and/or to a control unit which is integrated into the safety helmet 1, on the basis of which control unit the aerodynamic stabilizing element 2 is controlled.

Alternatively or additionally, the exemplary embodiment which is shown in the figure can have further features according to the embodiments of the general description.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMBERS

1. Safety helmet
2. Aerodynamic stabilizing element
3. Sensor element
4. Helmet shell
5. Energy supply unit
6. Energy interface

What is claimed is:

1. A safety helmet, comprising:
a helmet shell;
at least one aerodynamic stabilizing element at an exterior surface of the helmet shell, the at least one aerodynamic stabilizing element being movably connected to the helmet shell;
at least one actuator element configured to move the at least one aerodynamic stabilizing element relative to the helmet shell; and
at least one sensor element configured to detect at least one current driving state variables,
wherein
at least a portion of the at least one aerodynamic stabilizing element is movable by the at least one actuator element in a radially outward direction away from the helmet shell when the helmet is located on a wearer's head, and
movement of the at least one aerodynamic stabilizing element by the at least one actuator element is controlled as a function of the detected at least one current driving state variable.

2. The safety helmet as claimed in claim 1, wherein
the at least one aerodynamic stabilizing element is movable relative to the helmet shell into a first position and into a second position which is different from the first position, as a function of the detected at least one current driving state variable.

3. The safety helmet as claimed in claim 2, wherein
the at least one aerodynamic stabilizing element is movable into a plurality of further positions in addition to the first and second positions as a function of the detected at least one current driving state variable.

4. The safety helmet as claimed in claim 1, wherein the at least one sensor element includes an acceleration sensor.

5. The safety helmet as claimed in claim 4, wherein the acceleration sensor is a multi-axis acceleration sensor.

6. The safety helmet as claimed in claim 1, wherein
the at least one actuator element is a piezo-actuator.

7. The safety helmet as claimed in claim 1, wherein
the at least one sensor element is integrated with the helmet shell.

8. The safety helmet as claimed in claim 7, wherein
the at least one sensor element includes at least two sensor elements, and movement of the at least one aerodynamic stabilizing element is controlled as a function of at least one current driving state variable detected by a second one of the at least two sensor elements.

9. The safety helmet as claimed in claim 8, wherein the second one of the at least two sensor elements is a pressure sensor.

10. The safety helmet as claimed in claim 8, wherein
the second one of the at least two sensor elements is a speed sensor.

11. The safety helmet as claimed in claim 1, further comprising:
a control unit configured to
record measurement variables which are detected by the sensor element, and
control movement of the at least one aerodynamic stabilizing element as a function of the recorded measurement variables.

12. The safety helmet as claimed in claim 1, wherein
the at least one aerodynamic stabilizing element includes a plurality of aerodynamic stabilizing elements, and
movement of the plurality of aerodynamic stabilizing elements is controlled as a function of at least one detected current driving state variable.

13. The safety helmet as claimed in claim 1, further comprising:
an energy supply unit configured to be connected to at least one of the at least one sensor element and the at least one aerodynamic stabilizing element.

14. The safety helmet as claimed in claim 1, wherein movement of the at least one aerodynamic stabilizing element is controlled as a function of at least one driving state variable which is detected and transmitted by a vehicle.

* * * * *